United States Patent [19]

Reese

[11] 4,383,803

[45] May 17, 1983

[54] LIFTING LIQUID FROM BOREHOLES

[76] Inventor: Timothy E. Reese, 309 King Richard, Irving, Tex. 75061

[21] Appl. No.: 196,615

[22] Filed: Oct. 14, 1980

[51] Int. Cl.[3] ..... F04B 3/00

[52] U.S. Cl. ..... 417/259; 417/264; 417/403

[58] Field of Search ..... 417/259, 264, 403, 404

[56] References Cited

U.S. PATENT DOCUMENTS

| | | | |
|---|---|---|---|
| 1,851,801 | 3/1932 | Boone | 417/404 |
| 1,887,886 | 11/1932 | Grant | 417/404 |
| 1,946,454 | 2/1934 | Coberly | 417/403 |

*Primary Examiner*—Richard E. Gluck
*Assistant Examiner*—Peter M. Cuomo
*Attorney, Agent, or Firm*—Hubbard, Thurman, Turner & Tucker

[57] ABSTRACT

A device for lifting liquid from boreholes comprises a pump which is located downhole in the region of a production formation and which consists of a fluid-actuated, double-action piston. The pump is connected by fluid pressure lines to a source of fluid pressure disposed above ground and a switching valve is connected to provide fluid pressure to alternate sides of the piston to effect reciprocation thereof.

1 Claim, 5 Drawing Figures

LIFTING LIQUID FROM BOREHOLES

BACKGROUND OF THE INVENTION

The present invention relates to lifting liquid from boreholes.

Conventional devices for lifting oil from boreholes comprise a pump which is located downhole in the vicinity of a production formation, which may be a considerable distance below the ground surface, and which is connected by a string of sucker rods to a polish rod which extends through the well head and which is coupled via a walking beam to a rotary motor, or to a reciprocating fluid motor which reciprocates the polish rod and thereby the string of sucker rods and the piston of the downhole pump.

A major problem associated with this type of device is the wear to which the polish rod and the string of sucker rods are subjected. An additional major problem associated with strings of sucker rods is the fact that the movement of the sucker rods often wears holes in the walls of well tubing and casing. The polish rod has to suport the weight of the string and it, and the string, are subjected to continual acceleration and deceleration thereby causing considerable stresses in the string. Failure of the sucker rod string can lead to the loss of expensive downhole equipment and the expenditure of considerable non-productive time while downhole equipment is retrieved and replaced. Still another problem associated with strings of sucker rods is the large amount of energy that must be utilized to operate the string in a reciprocating manner.

It is an object of this invention to avoid the disadvantages inherent in the prior art designs.

It is a further object of the invention to provide a novel and improved device and method for lifting production fluids from boreholes.

It is yet a further object to provide a device which is capable of lifting heavy (low gravity) oil from boreholes.

It is a yet further object to provide a device which requires less energy to power it than prior art devices for pumping oil from oil bearing formations.

SUMMARY OF THE INVENTION

Accordingly, the present invention provides a device for lifting production fluid from a borehole comprising a fluid-actuated pump adapted to be disposed downhole and means for conveying fluid under pressure downhole to raise a piston of said pump and deliver production fluid from the borehole to a production fluid supply line connecting the pump to a well head.

The above and other features and advantages of the invention will be more readily understood by the detailed description of a preferred embodiment of the invention, which will now be given, by way of example only.

DETAILED DESCRIPTION OF THE PREFERRED EMBODIMENT

Figure 1:
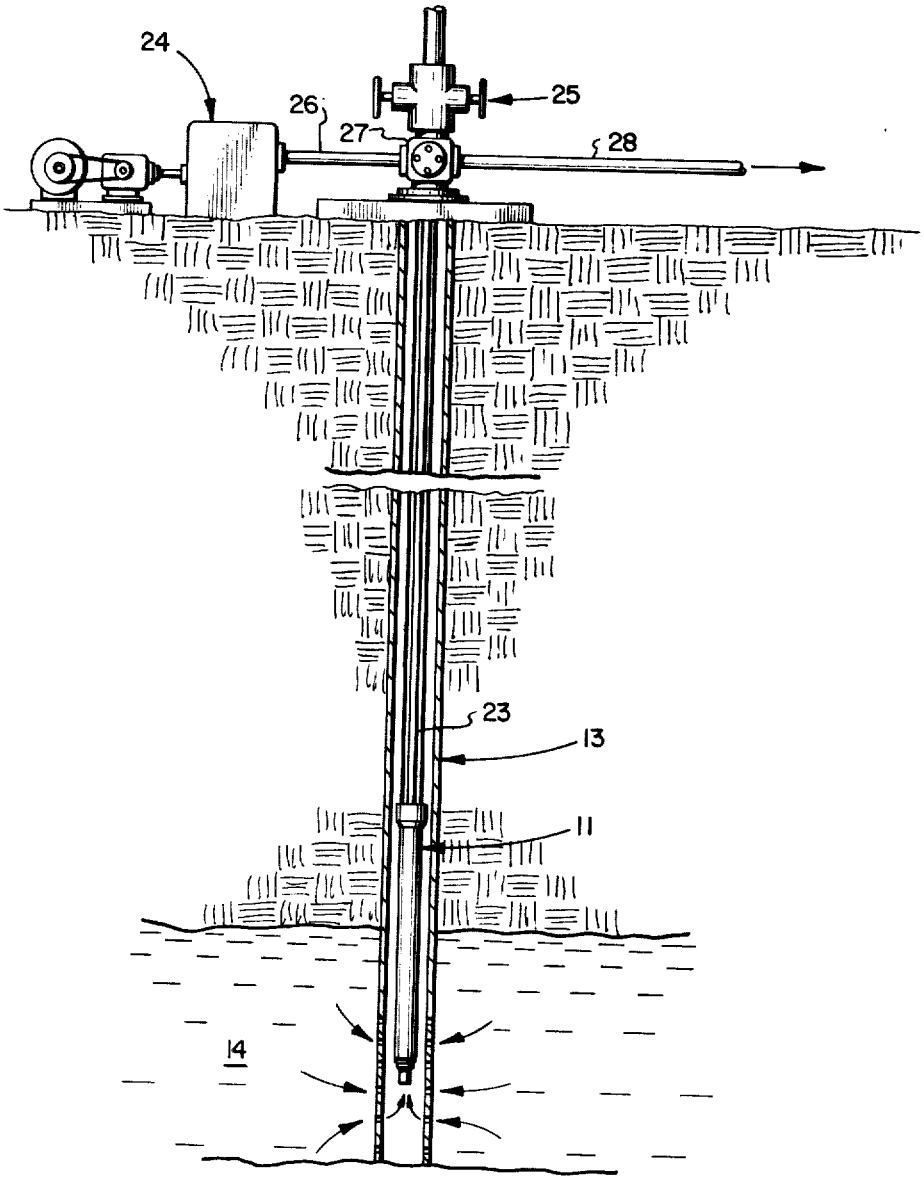
FIG. 1 is a schematic view of an arrangement embodying the invention for lifting oil from a below ground production formation.

Referring firstly to FIG. 1, the lifting device of the invention comprises a pump 11 which is disposed downhole in a well 13 in the vicinity of a production formation 14 and which includes a double-acting piston 15 (FIGS. 2 and 3) which is reciprocable in a cylinder 17, to the respective ends of which a pair of fluid supply lines 19 and 21 are connected. A production pipe 23 connects the pump 11 to a wellhead 25 and provides a conduit for the passage of production fluid from the production formation to the wellhead. A four way valve 27 selectively connects the two supply lines 19 and 21 to a supply of fluid under pressure or to an exhaust line.

The four way valve 27, the supply of pressurized fluid 24, the main pressurized fluid inlet line 26 and the main pressurized fluid exhaust line 28 are of conventional construction and will not be further described.

Figure 2:
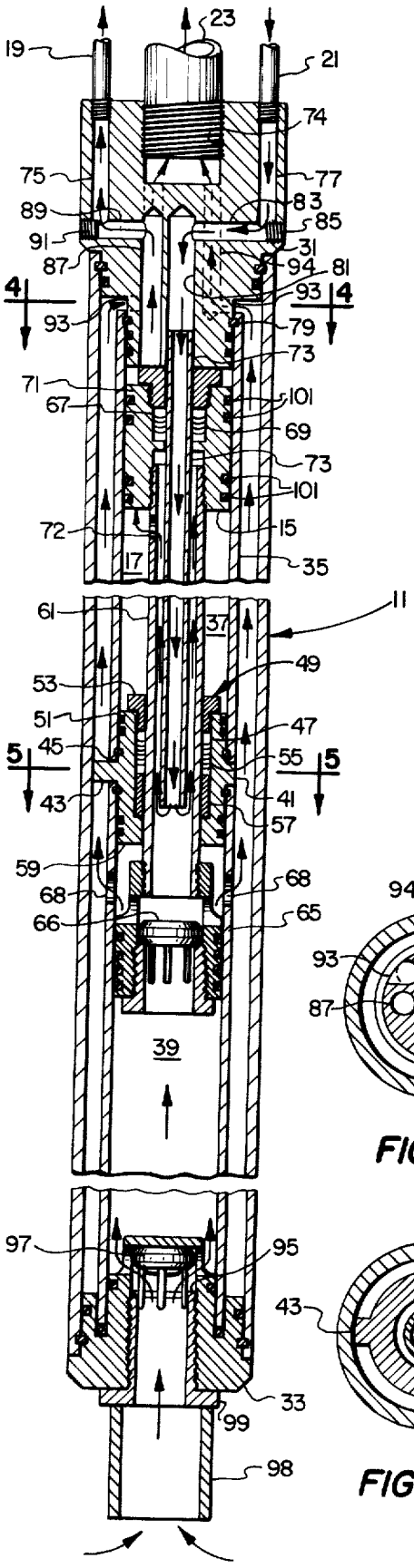
FIG. 2 is a vertical cross-section through the piston pump of FIG. 1 showing the pump during an upstroke.
Figure 4:
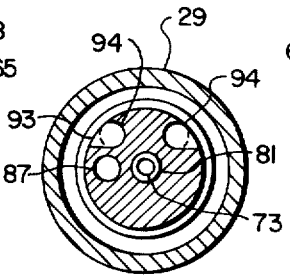
FIG. 4 is a sectional view of the piston pump taken along section line 4—4 of FIG. 2.
Figure 5:
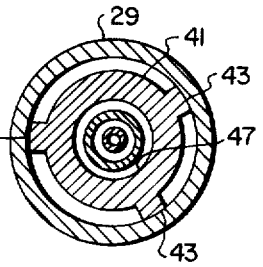
FIG. 5 is a sectional view of the piston pump taken along section line 5—5 of FIG. 2.
Figure 3:
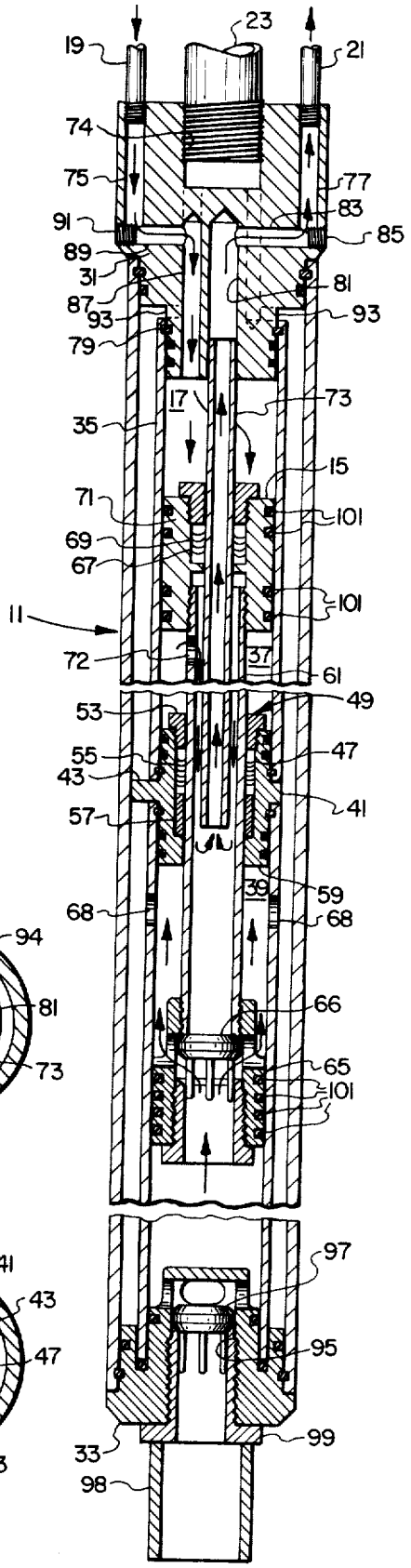
FIG. 3 is a vertical cross-section through the piston pump of FIG. 1, showing the pump during a downstroke.

Turning now to FIGS. 2 and 3, it will be seen that the downhole pump 11 comprises an outer cylindrical casing 29 closed at its ends by upper and lower end caps 31 and 33, which also provide mountings for an inner cylindrical member 35 coaxially disposed within the outer casing 29. The inner cylindrical member 35 is divided into upper and lower halves 37 and 39 by a fixed, bronze plug 41, which is secured in position by three radially extending flanges 43, extending through openings 45 in the cylindrical wall of the member 35. The plug 41 has a bore 47 extending axially therethrough in which is secured an olite bronze bushing 49 having a screw-threaded portion 51, which portion 51 extends into the bore 47 and engages an interior screw-threaded portion thereof, and an enlarged head portion 53.

A plurality of packing seals 55 are disposed within the bore 47 below the inner end of the bushing 49 and an inner bearing sleeve 57 is disposed below the packing seals 55, being retained in the bore 47 by an inwardly directed flange 59 of the plug 41.

A piston rod 61 extends through the bore 47 in the plug 41 and carries the said double-acting piston 15 disposed in the upper half 37 of the inner cylindrical member 35 and a lower piston 65 disposed in the lower half 39 of the inner cylindrical member 35. The lower piston 65 comprises a check valve 66 which allows fluid to flow upwardly past the piston 65 during downward movement of the piston 65 toward the lower end cap 33, but prevents return flow of the fluid during upward movement of the piston 65. Immediately below the plug 41, the inner cylindrical member 35 is formed with a ring of ports 68 providing communication between the interior of the inner cylindrical member 35 and the annular space between the member 35 and the outer casing 29.

The upper piston 15 comprises a cylindrical member through which extends an axial bore 67. The bore 67 has a relatively small diameter central portion and relatively larger diameter upper and lower portions. In the upper portion of the bore 67 is disposed a plurality of packing seals 69 and the upper end of the bore screwthreadedly receives a screw-threaded shank portion of an olite bronze bushing 71. A fixed tube 73 is secured to the upper end cap 31 and extends coaxially through the interior of the piston rod 61 and has an open lower end level with the inner bearing sleeve 57 within the plug 41. At its upper end, just below the piston 15, the rod 61 is formed with a port 72 connecting the interior of the rod 61 with the annular space between the rod 61 and the inner cylindrical member 35.

The upper end cap 31 has at its upper end a centrally disposed bore 74 which is internally screw-threaded for connection to the lower end of the production pipe 23. Two smaller screw-threaded bores 75 and 77, located at opposite ends of a diameter, provide connections to the two fluid supply lines 19 and 21 respectively. At its lower end, the upper end cap 31 is sealingly secured by means of a retaining ring 79 within the inner cylindrical member 35, closing the upper end thereof. A central bore 81 in the lower end of the upper end plug 31 receives the upper end of the tube 73, which is welded thereto prior to assembly. The bore 81 communicates with a radially outwardly extending bore 83, sealed by a plug 85 at its outer end, which in turn communicates with the fluid-supply line bore 77. A bore 87, offset from the axis of the cap 31 extends from the lower end thereof to communicate with a radial bore 89, the outer end of which is closed by a plug 91, which in turn communicates with the fluid supply bore 75. A plurality of entry ports 93 in the lower portion of the side wall of the end cap 31 communicate with two axially extending passages 94 through the cap 31, which communicate with the centrally disposed bore 74.

The lower end cap 33 has a centrally disposed bore 95 in which is mounted a check valve 97, which permits production fluid to flow from the bore hole into the interior of the inner cylindrical member 35, but which prevents flow in the opposite direction. The open end of the bore 95 is protected by a cylindrical shroud 98 welded to a flanged bush 99 which is secured by cooperating screw-threads in the bore 95. If desired, a screen can be positioned over the opened end of shroud 98 to prevent large stones, sand and other foreign bodies from being sucked into the pump.

The cylindrical surfaces of the upper and lower pistons 63 and 65 carry metal piston rings 101 which sealingly engage the inner cylindrical surface of the inner cylindrical member 35.

The operation of the pump 11 will now be described, starting from the condition illustrated in FIG. 2 of the drawings. In FIG. 2, the pump 11 is shown with the piston rod 61 in its fully raised position with the double acting piston 15 below and adjacent the upper end cap 31 and the lower piston 65 below and adjacent the fixed plug 41. To drive the piston downwardly, the four way fluid valve 27 is operated to connect supply line 19 to the source of fluid pressure and to exhaust the supply line 21. Fluid under pressure passes from the line 19, through the bores 75, 89, 87 and impinges on the upper working surface of the double-acting piston 15, driving the piston 15 downwardly through the upper half 37. The lower piston 65 is moved downwardly through the lower half 39 with the check valve 66 open, allowing production fluid in the lower half 39 to flow past the piston 65 into the portion of the lower half 39 above the piston 65. After an appropriate time interval, the valve 27 connects the line 19 to exhaust and supplies fluid under pressure to the line 21. The fluid passes through the bores 77, 83 and 81, down through the tube 73, back up through the annular space between the tube 73 and the inner cylindrical member 35 and through the ports 72 to act against the underside of the piston 15, thus raising the piston rod 61. As the lower piston 65 is raised, the check valve 66 is closed and the production fluid inside the cylinder half 39 above the piston 65 is lifted, passing through the port 68, along the annular space between the casing 29 and the member 35, through the ports 93, the passages 94 and the central bore 74, into the production pipe 23.

The regular cycling of the pump as described above, at a rate of about one stroke per minute, will lift production oil at a very acceptable rate. Moreover, the pump 11 will lift the heaviest oil that will flow, at 4 to 8 degrees. It will be appreciated that the motor required to pump the fluid in the supply lines 19 and 21 is considerably smaller than the motor required to reciprocate the sucker rods of a conventional lifting device so that the pump of the present invention reuires less energy to operate it than a conventional lifting device.

Moreover, there is very little wear on the pump 11 and it should perform several million cycles before any appreciable wear occurs.

The pump 11 will pump normal formation sand without wear, and suitably dimensioned, can pump rocks up to ¼" in size without appreciable wear.

The pump 11, as described above, can operate satisfactorily at temperatures up to 500° F. This compares very favorably with conventional lifting devices, which cannot function properly at temperatures much in excess of 120° F.

When the pump 11 is to handle heavy viscous oils, steam may be used as the fluid driving the piston 15. This has the great advantage of raising the temperature of the oil, reducing its viscosity and assisting its flow.

Because of the simple arrangement of the moving parts of the pump of this invention, oil can be pumped, even when it contains large quantities of sand, rock and the like, without material wear or harm to the pump.

It will be appreciated that the speed of reciprocation as well as the length of the stroke can be varied by simply manipulating the amount of pressurized fluid admitted and withdrawn to and from the pump.

It will also be appreciated that any pressurized fluid such as compressed gases or liquids can be used as the operating fluids in the pumps of this invention.

While the foregoing specification has been directed to positioning the disclosed pump in a borehole for lifting fluids, it will be appreciated that the pump can be disposed in other locations for pumping fluids. For example, the disclosed pump can be located above ground or in horizontal fluid conduits for pumping liquids or fluids in any desired manner.

Although preferred embodiments of the invention have been described in detail, it should be understood that various changes, substitutions and alterations can be made therein without departing from the spirit and scope of the invention as defined by the appended claims.

What is claimed is:

1. A device for lifting liquid from a borehole comprising a fluid-actuated pump adapted to be operated downhole incuding an outer casing member, an inner casing member coaxially mounted within the outer casing member, means dividing the inner casing member into upper and lower chambers, a first piston mounted for reciprocation within said upper chamber, a second piston mounted for reciprocation within said lower chamber and a hollow piston rod interconnecting the first and second pistons, means for delivering fluid under pressure selectively to points in the upper chamber above and below said first piston respectively, to reciprocate the first piston in the upper chamber, and thereby the second piston in said lower chamber, valve means associated with said second piston for allowing fluid from the borehole to pass the second piston during a downward stroke thereof, means connecting the interior of the lower chamber with the annular space defined between the inner and outer casing members at a position above the uppermost point of travel of the second piston, means connecting the upper end of said annular space with a pipe for conveying said fluid to the surface, an end cap closing the upper end of said outer casing, said end cap having a first passage means extending therethrough for connecting said fluid conveying pipe to said annular space, a second passage means extending therethrough for conveying pressurized fluid to the interior of the upper chamber above said first piston and a third passage means extending therethrough for conveying pressurized fluid to a tube which is located within said upper chamber and extends through said first piston to deliver said pressurized fluid to the bottom of said upper chamber to act on the underside of said first piston.

* * * * *